US005996190A

United States Patent [19]

Peterson

[11] Patent Number: 5,996,190

[45] Date of Patent: Dec. 7, 1999

[54] COMBINATION TABLE COVER AND SKIRT RETAINER WITH A FLORAL ARRANGEMENT FASTNER AND AN ADVERTISING DEVICE

[76] Inventor: Rita Rae Peterson, 20711 43rd Ave., Port Byron, Ill. 61275

[21] Appl. No.: 09/267,591

[22] Filed: Mar. 12, 1999

[51] Int. Cl.[6] ..... A44B 21/00; A47B 13/00

[52] U.S. Cl. ..... 24/457; 24/455; 24/459; 24/523; 24/306

[58] Field of Search ..... 24/457, 455, 459, 24/523, 306

[56] References Cited

U.S. PATENT DOCUMENTS

| | | | |
|---|---|---|---|
| 0,640,250 | 1/1900 | Zimmlinghaus | 24/523 |
| 1,521,481 | 12/1924 | Spencer | 24/457 |
| 2,004,231 | 6/1935 | Wasson | 24/457 |
| 2,179,694 | 11/1939 | Haveles | 24/457 |
| 2,260,584 | 10/1941 | Schuck et al. | 24/457 |
| 3,368,601 | 2/1968 | Gantert-Merz | 24/306 |
| 3,959,854 | 6/1976 | Lewis | 24/457 |
| 4,708,183 | 11/1987 | Figueroa | 24/523 |
| 4,947,526 | 8/1990 | Fogelman | 24/336 |
| 5,287,614 | 2/1994 | Ehrlich | 29/450 |

*Primary Examiner*—Victor N. Sakran

[57] ABSTRACT

A retainer to attach a table cover and table skirt to a banquet table. Comprising a series of c-clamp type retainers to grippingly hold the table cover in place and provide a connection for a supporting pin and a supporting loop. The supporting pin mounted on the vertical face of the c-clamp retainer to support the vertical component of weight of an attached table skirt. A supporting loop in the upper leg of the c-clamp retainer to accept wire or string to then bind floral arrangement, etc. to be displayed in front of the table. A spring clip assembly to grippingly engage the supporting pin and hold the skirt in place horizontally. A free surface on the spring clip assembly to exhibit decorative or commercial designs.

6 Claims, 1 Drawing Sheet

COMBINATION TABLE COVER AND SKIRT RETAINER WITH A FLORAL ARRANGEMENT FASTNER AND AN ADVERTISING DEVICE

TITLE OF INVENTION

Combination table cover and skirt retainer with a floral arrangement fastener and an advertising device.

CROSS REFERENCE TO RELATED APPLICATIONS

U.S. Pat. Nos.

3,959,854 June 1976 Lewis . . . 24/84B 4,708,183 November 1987 Figueroa . . . 24/306

5,287,614 February 1994 Ehrlich . . . 29/450

STATEMENT REGARDING FEDERALLY SPONSORED RESEARCH OR DEVELOPMENT

Not applicable.

REFERENCE TO A MICROFICHE APPENDIX

Not applicable.

BACKGROUND OF THE INVENTION

The invention relates to a retainer for detachably connecting a table cover, a table skirt, and floral work or other devices to adjacent edges of a table with the option of exhibiting company logos in view of guests.

The retainer is designed for use with tables, with or without tablecloths, having an overhanging skirt portion that covers the front of the table and is separate from any tablecloth.

Table skirts are used on a variety of types of tables such as dining tables, and banquet tables. They are used to mask the legs of the tables and hide items under the table. Their time of use is often during formal occasions. At weddings and the like floral arrangements are often placed in front of the skirts to complement the decor of a hall. At conventions, signs are often placed in front of tables to inform patrons. These events are often held in commercial establishments where setup costs are incurred and where it would sometimes be beneficial to display an attractive inconspicuous company logo.

Heretofore skirts have been normally held with thumb tacked or have been stapled to the table. If garland, signs, or floral arrangements or the like are desired in front of the table they are usually pinned to the skirt or thumb tacked to the table. Signs and garland are often pinned to the front of the skirt. These methods of attaching skirts and other items to the table are time consuming and costly, often fail, and do not leave the formal appearance that is desirable. They also tend to damage the tables they are being connected to.

In prior art, exemplified by U.S. Pat. No. 3,959,854 Lewis June 1976, U.S. Pat. No. 4,708,183 Figueroa November 1987, and U.S. Pat. No. 5,287,614 Ehrlich February 1994, alterations in the table skirt and some type of retainer are required to make the attachments of the table skirt to the table top. This prior art does not provide for a method of providing support for the placement of decorative items in front of the table skirt. Unlike the prior art, this invention does not require any alteration to the table skirt to provide attachment of the table skirt to the table top.

BRIEF SUMMARY OF THE INVENTION

The skirt retainer, that also serves as a floral or item retainer, and as a mount for an advertising logo, which is the subject of this application, comprises of a c-clamp retainer member that typically consists of web portion and two outwardly projecting flanges. With the flanges having a screw type plunger with a pressure foot on one flange, and a clamping surface on the other flange. The flanges are adapted to engage upper and lower surfaces of a tabletop when the screw plunger is tightened. The upper flange has a punched open raised loop that will accept wire or string to secure floral arrangements, signs, etc. in front of the table skirt. The web portion of the c-clamp retainer is the vertical portion. A notched pin is attached to this web portion of the device. This pin being similar to, but larger than, those used in military pins or earrings. This pin will be one element of the fastener that will support the weight of the table skirt, which extends around the periphery of the table. In the preferred embodiment of the invention, this fastener comprises of the aforementioned pin and a spring-loaded clip assembly that can be similar to those used in military buttons that preferably will be larger in size, with optional side releases to ease placement. The table skirt is pushed over the pin and secured in place with the spring-loaded clip assembly. The attaching clip assembly can be decorative to fit in with formal occasions, or may be used as a base for an advertising logo if desired.

This invention would provide a fast, more secure, formal method of attaching standard skirts and floral work to banquet tables, with the added advertisement potential. Damage that would occur from the use of staples and thumb tacks would be eliminated.

In prior art, exemplified by U.S. Pat. No. 3,959,854 Lewis June 1976, U.S. Pat. No. 4,708,183 Figueroa November 1987, and U.S. Pat. No. 5,287,614 Ehrlich February 1994, alterations were made to table skirts and a clipping device was utilized to support the table skirt. This invention has the advantage over prior art insofar as it provides for a means to attach table skirts of various materials, without making modifications to the table skirt. Because specialty skirts are not required, plain paper or plastic table skirts can be used with the same retainer as well as the more formal pleated cloth skirts. The invention also provides for a means to positively support relatively heavy items in front of the table skirt. This need is not provided for in the prior art.

BRIEF DESCRIPTION OF THE DRAWINGS

For a full understanding of the preferred embodiment of the present invention, reference may be had to the following detailed description taken in conjunction with the accompanying drawings in which.

DETAILED DESCRIPTION OF THE INVENTION

Figure 1:
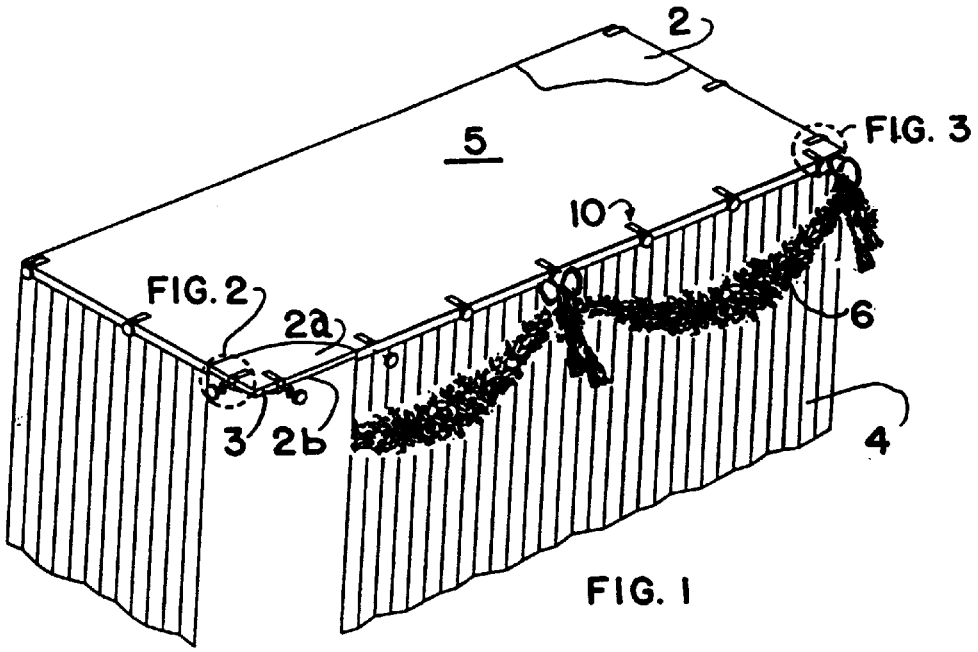
FIG. 1 is a perspective view showing the retainers detachably connecting a table cover having a separately attached overhanging skirt portion to a table and an attached floral arrangement.

Referring to FIG. 1 of the drawing, the number 5 generally designates a table cover having a top portion and a separately attached skirt portion 4. Table cover portion 5 is illustrated covering a table top 2 which has upper and lower surfaces 2 *a* & 2 *b*, respectively, and an edge or periphery 3. The numeral 10 generally designates a c-clamp retainer member that can be positioned to grippingly engage the upper and lower surfaces 2 *a* & 2 *b* of tabletop 2 adjacent to the periphery thereof. The secured clamp 10 thusly secures cover 5 to tabletop 2 and likewise provides a means of securing skirt 4 along the table and provides a means of supporting decorative items 6 in front of skirt 4.

Figure 2:
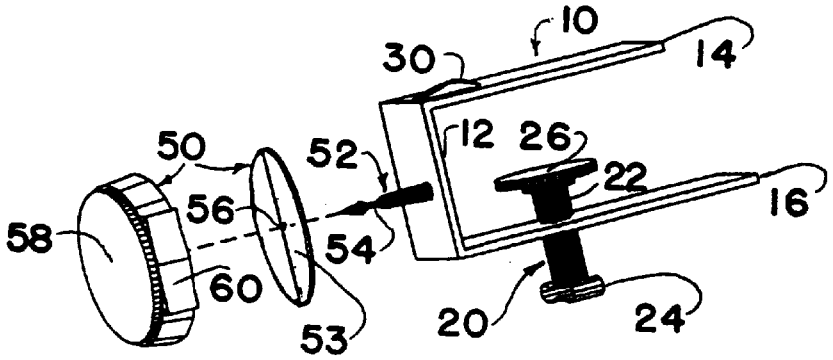
FIG. 2 is an enlarge perspective view showing the retainer.

Referring to FIG. 1 and FIG. 2 of the drawing, retainer member 10 comprises a generally c-clamp retainer member having a web portion 12 and outwardly extending flange portions forming spaced legs 14 and 16 positioned to receive a table edge there between. Leg 14 of retainer 10 is preferably covered with a resilient cushion to prevent marring or scratching of the tabletop. The second leg 16 is spaced from the first leg 14 to facilitate placing retainer member 10 into position adjacent the periphery 3 of the edge of the tabletop 2.

Leg 16 has a threaded hole that incorporates a suitable gripping apparatus for securing retainer 10 in position. In the embodiment illustrated in FIG. 2 of the drawing, the gripping apparatus comprises a screw type plunger 20, having a shank portion 22 and a butterfly grip 24 secured to the bottom end thereof. A gripping plate 26 is located at the upper end of shank 22 to engage the table.

A pin fastener 52 is bonded or otherwise secured to web 12 of retainer 10 and when used with the spring-loaded clip assembly 50 secures the skirt portion 4 of the table cover to the tabletop 2. Fastening pin 52 preferably comprises a pointed metal pin with a notch 54 formed on the pin designed to be a stop for spring-loaded clip assembly 50. The fastening pin 52 will support the vertical component of the weight of the skirt.

In the embodiment shown the spring-loaded clip assembly device, item 50, has overlapping plates with a formed shape 56 designed to frictionally engage the pin 52 and notch 54. This is preferably a spring-loaded clip with optional side releases 60 and a free exterior surface 58 that can be used as a base for logos or decorative figures. The spring-loaded clip assembly 50, when engaging pin 52, will provide the horizontal support for the skirt 4 of the table.

In the embodiment illustrated in FIG. 2 of the drawing, fastener 30 is a raised punched section of leg 14. The raised section is designed to accept fine wire, string, etc. to support floral items 6 in front of the skirt 4.

If table cover 5 is to be used, the table cover 5 is first positioned on tabletop 2. A plurality of retainers 10 are preferably positioned at spaced locations around the periphery of the table top for maintaining table cover 5 in position when secured with connectors 50 and 52. Retainer 10 will be placed in similar locations in direct contact with the table if the table cover is not used.

Retainer 10 will be held in place be friction due to pressure from the rotation of the screw plunger 20. Leg 14 will rest against the upper surface 2 *a* of the tabletop 2 and the gripping plate 26 will be in contact with the lower surface 2 *b* of the tabletop 2. The plunger 20 consists of three parts: the gripping surface 26, the threaded shank 22, and the butterfly grip 24 for gripping to turn the plunger 20. The threaded shank 22 will pass through a threaded hole in leg 16 of the retainer 10 and with rotation will lower and raise the plunger 20 to apply and release pressure on the tabletop 2.

Table skirt 4 is then attached to the table by pushing skirt 4 over fastening pin 52 and securing skirt 4 with the spring-loaded clip assembly retainer 50 to form a straight smooth edge around the periphery of the table top. Table skirt 4 need not comprise a conventional "table skirt" but may be paper, plastic, or some other type of material that could, if desired, display advertising or instructional material or the like.

In the illustrated embodiment of the invention the raised punched section 30 of leg 14 of retainer 10 is provided to accept wire or string that then will bind floral item 6 in front of the table skirt 4. Floral items 6 need not comprise only "floral arrangements" but may be employed to support a sign, a display or other items that may be desirous to hang in front of the table skirt.

In the illustrated embodiment of the invention, the upper leg 14 of retainer 10 is relatively short and is narrow. However, in certain applications it may be desirable to form upper leg 14 such that it is substantially longer and/or wider than that illustrated to engage greater surface area on table cover 5. In addition, it will be readily apparent that web 12 of retainer 10 need not be a straight planer member and that it may assume any shape or configuration to conform to the periphery 3 of the table top 2.

Figure 3:
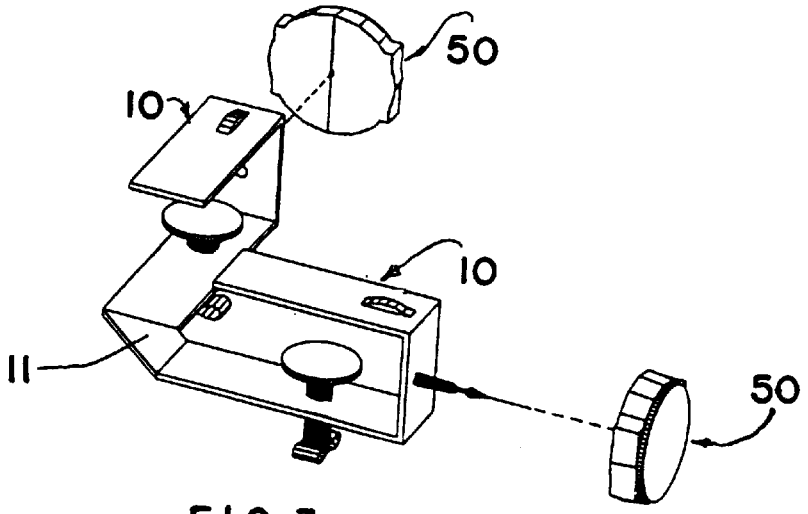
FIG. 3 is an enlarged perspective view showing the corner retainer assembly.

In FIG. 3 in the illustrated embodiment of the invention, in lieu of using 2 individual retainer 10's at the corners of tabletop 2, the lower legs 16 of the retainers 10 may be joined together with an additional section 11 of like material. This generally L-shaped member to be placed on the corners of tabletop 2. The two legs 16 are connected, as shown, to provide a more secure clamp that will limit any horizontal movement of the c-clamp retainers 10 if heavy items are attached to fastener 30 and/or fastening pin 52. The connecting area 11 as shown is for illustration purposes only and could be extended towards the flange to provide a stronger and more stable corner.

Retainers 10 and 50 may be provided with a decorative or ornamental appearance to enhance the appearance of the table.

It should be noted that gripping mechanism 20 in the illustrated embodiment comprises a screw shaft 22 and a pressure foot 26, other gripping devises such as screws, cams or wedges may be employed for gripping the edge of the table top. For lighter loads a resilient c-clip could be used, in lieu of the c-clamp screw system, thusly eliminating the gripping mechanism 20.

It should be noted that a retainer clip 59 in the illustrated embodiment was noted as a spring clip, other gripping devises such as cams or wedges may be employed for gripping the pin 52. It should also be noted that the raised punched fastener 30 in the illustrated embodiments could be replaced by another attaching device on leg 14 such as a loop or hook attached to leg 14.

In the embodiment one pin 52 is shown. If rectangular logos are desirous, or if added support is needed, more than one pin 52 could be provided on clip 10.

What is claimed is:

1. A retainer to secure a table cover, a table shirt and accessories adjacent the edge of a tabletop of said table comprising:

a retainer member comprising two leg sections defining an upper leg section and a lower leg section and a separating flange disposed between said two leg sections and being parallel to each another;

a flange section adjoining the two leg sections at right angles to the flange and parallel to each other with said legs placed so as to grip the tabletop;

a resilient material bonded to the upper leg section to prevent marring of the tabletop;

a screw plunger threaded through an accepting threaded hole on the lower leg to engage the edge of the tabletop to hold said retainer in place; said retainer member when used with pin fastener and a clip assembly being removable to alternately hold in place and allow removal of the table cover and table skirt in respect to the adjacent edge of the table top;

a pin fastener bonded to said flange section of the retainer to support the vertical component of the weight of the table skirt;

a spring-clip assembly to engage and disengage said pin fastener to facilitate the placement and removal of the table skirt in place when utilized with the pin fastener above; a connector defining a raised punched section formed in said upper leg section to provide support for the attachment of floral arrangements.

2. The assembly of claim 1 whereas the pin fastener comprises:

a pin that is bonded to the flange of the retainer to accept the weight of the table skirt;

a notch formed in the pin fastener to act a stop for the spring-clip.

3. The assembly of claim 1 whereas the spring-clip assembly comprises:

a pair of overlapping spring-loaded clips to engage the pin fastener;

a side release on the spring-loaded clip assembly to release pressure on spring loaded clips for removal.

4. The assembly of claim 3 whereas a surface on the spring clip assembly is designed to have exterior exposed surfaces to exhibit advertising or decorative items.

5. The assembly of claim 1 whereas an open loop in the upper leg section to accept wire or other attaching apparatus to secure floral arrangements said table.

6. A variation of the assembly of claim 1 wherein an additional L-shaped member so that can be joined at the lower flange at right angles to one another and placed on the corners of said table to provide a method to support the horizontal component of the forces caused by the loads placed on the retainer assemblies.

* * * * *